US008342624B2

(12) United States Patent
Suzuki

(10) Patent No.: US 8,342,624 B2
(45) Date of Patent: Jan. 1, 2013

(54) RECORDING APPARATUS

(75) Inventor: Yoshihumi Suzuki, Ena (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 361 days.

(21) Appl. No.: 12/690,191

(22) Filed: Jan. 20, 2010

(65) Prior Publication Data

US 2010/0182362 A1 Jul. 22, 2010

(30) Foreign Application Priority Data

Jan. 20, 2009 (JP) ..... 2009-010349

(51) Int. Cl.
*B41J 29/38* (2006.01)

(52) U.S. Cl. ..... 347/11; 347/9; 347/10; 347/14

(58) Field of Classification Search ..... 347/9–11, 347/14

See application file for complete search history.

(56) References Cited

U.S. PATENT DOCUMENTS 5,107,276 A * 4/1992 Kneezel et al. ..... 347/60
5,168,284 A * 12/1992 Yeung ..... 347/17
5,736,995 A * 4/1998 Bohorquez et al. ..... 347/14
6,568,779 B1 * 5/2003 Pulman et al. ..... 347/10
7,500,729 B2 * 3/2009 Sakaida ..... 347/14
2006/0221112 A1 10/2006 Ito

FOREIGN PATENT DOCUMENTS

JP 2006-272909 10/2006

* cited by examiner

*Primary Examiner* — Stephen Meier
*Assistant Examiner* — Jeremy Bishop
(74) *Attorney, Agent, or Firm* — Scully, Scott, Murphy & Presser, PC

(57) ABSTRACT

A recording apparatus includes a recording head having: a discharge port; an actuator; and a driving circuit that selectively supplies to the actuator a discharge driving signal which includes at least one of discharge pulse signals, and a non-discharge driving signal which includes at least one of non-discharge pulse signals. The recording apparatus further includes: a transport unit; an image recording control unit; a signal number calculating unit that calculates the number of non-discharge driving signals; and a non-discharge driving control unit that controls the driving circuit to supply the number of non-discharge driving signals calculated by the signal number calculating unit, wherein the signal number calculating unit calculates the number of non-discharge driving signals such that the sum of the number of correction pulses and the total number of non-discharge pulse signals supplied to the actuator within the predetermined period is equal to a predetermined value.

10 Claims, 11 Drawing Sheets

RECORDING APPARATUS

CROSS REFERENCE TO RELATED APPLICATION

The present application claims priority from Japanese Patent Application No. 2009-010349, which was filed on Jan. 20, 2009, the disclosure of which is herein incorporated by reference in its entirety.

TECHNICAL FIELD

Apparatuses and devices consistent with the present invention relate to a recording apparatus including a recording head that has an actuator and a driving circuit that supplies a driving signal to the actuator.

BACKGROUND

There is a related art recording apparatus including an actuator that discharges a liquid from a discharge port formed in a recording head. When the actuator of the related art recording apparatus is continuously driven and the temperature of the actuator is increased, the driving characteristics of the actuator sometimes vary. Therefore, the related art recording apparatus discloses a structure in which, when the ambient temperature of the actuator is equal to or lower than a predetermined temperature, a non-discharge driving signal is supplied to a driving IC and a head is heated by heat generated from the actuator and the driving IC. As described above, the temperature of the head of the related art recording apparatus is controlled to prevent a variation in the driving characteristics of the actuator due to the temperature.

SUMMARY

However, when the temperature of the head is controlled on the basis of the detected temperature as described in the related art recording apparatus, it is difficult to appropriately perform temperature control in response to temperature variation. When the temperature of the head is controlled on the basis of the detected temperature, it is necessary to accurately detect the temperature of the head. Even though the temperature of the head is detected accurately, the temperature varies depending on the driving conditions of the head.

An object of the invention is to provide a recording apparatus capable of appropriately controlling the temperature of a recording head.

According to one aspect of the present invention, there is provided a recording apparatus comprising: a recording head that comprises: a discharge port through which a liquid is discharged; an actuator that discharges the liquid from the discharge port; and a driving circuit that selectively supplies to the actuator a discharge driving signal, which includes at least one of discharge pulse signals and is used to drive the actuator so as to discharge the liquid from the discharge port, and a non-discharge driving signal, which includes at least one of non-discharge pulse signals and is used to drive the actuator so as not to discharge the liquid from the discharge port, a transport unit that transports a recording medium to a position facing the recording head; an image recording control unit that controls the actuator to discharge the liquid onto the recording medium transported by the transport unit on the basis of image data; a signal number calculating unit that calculates the number of non-discharge driving signals supplied from the driving circuit to the actuator on the basis of the image data; and a non-discharge driving control unit that controls the driving circuit to supply the number of non-discharge driving signals calculated by the signal number calculating unit, wherein the signal number calculating unit calculates the number of non-discharge driving signals such that the sum of the number of correction pulses for correcting the total number of discharge pulse signals supplied to the actuator within a predetermined period to be reduced and the total number of non-discharge pulse signals supplied to the actuator within the predetermined period is equal to a predetermined value.

According to the recording apparatus of the invention, the temperature of the head is controlled by making the number of pulses supplied from the driving circuit to the actuator equal to a predetermined value. Therefore, it is possible to appropriately perform temperature control in response to temperature variation, as compared to the structure in which the temperature of the head is controlled on the basis of the detected temperature. In addition, when the liquid is discharged from the discharge port, the recording head is cooled by the liquid supplied to the recording head. However, in the invention, the number of correction pulses, which is estimated to reduce the total number of discharge pulse signals included in the discharge driving signal, is used. Therefore, it is possible to control the temperature of the head, appropriately considering the amount of liquid discharged from the discharge port, by making the sum of the number of correction pulses and the number of pulse signals included in the non-discharge driving signal equal to a predetermined number.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Hereinafter, exemplary embodiments of the invention will be described with reference to the accompanying drawings.

Figure 1:
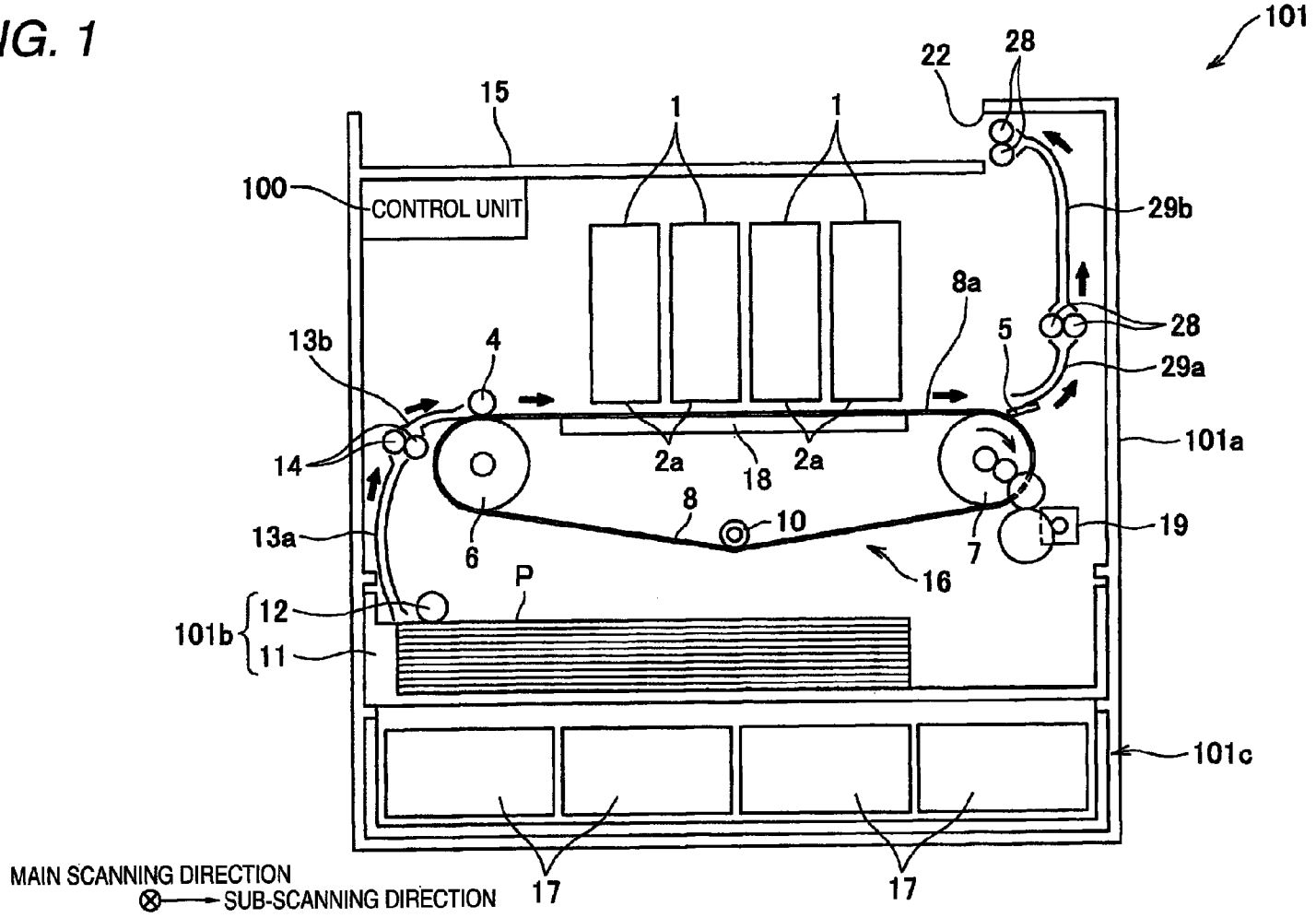
FIG. 1 is a longitudinal cross-sectional view illustrating the internal structure of an ink jet printer including an ink jet head according to an embodiment of the invention.

FIG. 1 is a longitudinal cross-sectional view illustrating the internal structure of an ink jet printer including an ink jet head according to an embodiment of the invention. As shown in FIG. 1, an ink jet printer 101 includes a case 101*a* having a rectangular parallelepiped shape. Four ink jet heads 1 (hereinafter, referred to as heads 1) that respectively discharge magenta, cyan, yellow, and black inks and a transport mechanism 16 are provided in the case 101*a*. A control unit 100 that controls the operations of, for example, the heads 1 and the transport mechanism 16 is provided on the inner surface of the ceiling of the case 101*a*. A sheet feed unit 101*b* is provided below the transport mechanism 16 so as to be detachable from the case 101*a*. An ink tank unit 101*c* is provided below the sheet feed unit 101*b* so as to be detachable from the case 101*a*.

In the ink jet printer 101, a sheet transport path is formed in the direction of an arrow shown in FIG. 1, and a sheet P is transported from the sheet feed unit 101*b* to a sheet discharge unit 15. The sheet feed unit 101*b* includes a sheet feed tray 11 and a feed roller 12. The sheet feed tray 11 has a box shape with the top open and a plurality of sheets P is accommodated in the sheet feed tray 11. The feed roller 12 transports the uppermost sheet P in the sheet feed tray 11.

The transported sheet P is sent to the transport mechanism 16 while being guided by guides 13*a* and 13*b* and pinched between a pair of transport rollers 14.

The transport mechanism 16 includes two belt rollers 6 and 7, a conveyor belt 8, a tension roller 10, and a platen 18. The conveyor belt 8 is an endless belt that is wound around the two rollers 6 and 7. The tension roller 10 is urged downward while coming into contact with an inner circumferential surface of the conveyor belt 8 in a lower loop of the conveyor belt 8, and applies tension to the conveyor belt 8. The platen 18 is arranged in a region that is surrounded by the conveyor belt 8 and supports the conveyer belt 8 so that it does not sag down at a position facing the heads 1. The belt roller 7 is a driving roller. When a driving force is applied from a transport motor 19 to a shaft of the belt roller 7, the belt roller 7 is rotated in the clockwise direction in FIG. 1. The belt roller 6 is a driven roller. When the conveyor belt 8 is rotated by the rotation of the belt roller 7, the belt roller 6 is rotated in the clockwise direction in FIG. 1. The driving force of the transport motor 19 is transmitted to the belt roller 7 through a plurality of gears.

A silicon treatment is performed on an outer circumferential surface 8*a* of the conveyor belt 8 such that the outer circumferential surface 8*a* has adhesion. A nip roller 4 is provided so as to face the belt roller 6. The nip roller 4 presses the sheet P transported from the sheet feed unit 101*b* against the outer circumferential surface 8*a* of the conveyor belt 8. The sheet P pressed against the outer circumferential surface 8*a* is transported in a sheet transport direction (a sub-scanning direction which is the direction to the right in FIG. 1) while being held on the outer circumferential surface 8*a* by the adhesion of the outer circumferential surface 8*a*.

A separation plate 5 is provided at a position facing the belt roller 7. The separation plate 5 separates the sheet P from the outer circumferential surface 8*a*. The separated sheet P is transported while being guided by guides 29*a* and 29*b* and pinched between two sets of transport roller pairs 28. The sheet P is discharged from an outlet 22 that is formed in an upper portion of the case 101*a* to a sheet discharge concave portion (sheet discharge portion) 15 that is provided in the upper surface of the case 101*a* (ceiling).

The four heads 1 discharge different color inks (magenta, yellow, cyan, and black). Each of the four heads 1 has a substantially rectangular parallelepiped shape that is elongated in the main scanning direction. The four heads 1 are fixed and arranged in the transport direction A of the sheet P. That is, the printer 101 is a line type and the transport direction A is orthogonal to the main scanning direction.

The bottom of the head 1 is a discharge surface 2*a* in which a plurality of discharge ports 108 (see FIG. 5) for discharging ink is formed. When the transported sheet P passes below all of the four heads 1, color inks are sequentially discharged from the discharge ports 108 onto the upper surface of the sheet P. In this way, a desired color image is formed on the upper surface, that is, a printing surface of the sheet P.

The heads 1 are connected to corresponding ink tanks 17 in the ink tank unit 101*c*. Different color inks are stored in the four ink tanks 17. The color inks are supplied from the ink tanks 17 to the heads 1 through tubes.

Figure 2A:
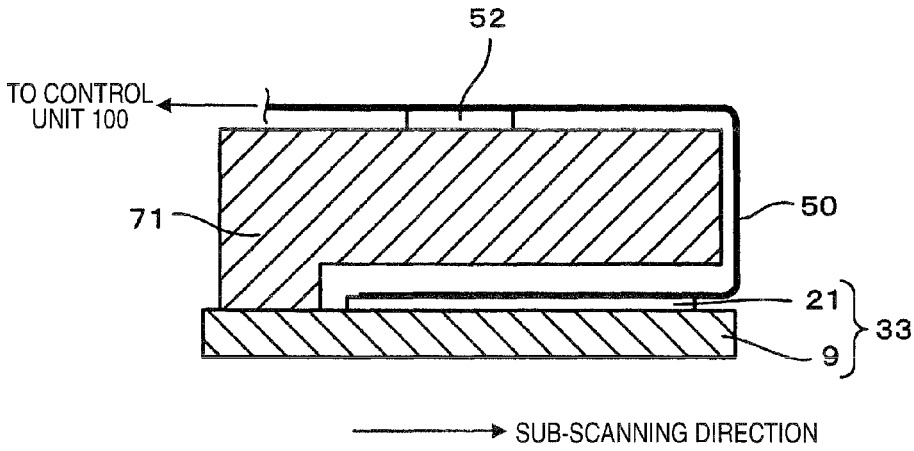
FIG. 2A is a cross-sectional view illustrating the ink jet head taken along a sub-scanning direction, which is a lateral direction.
Figure 2B:
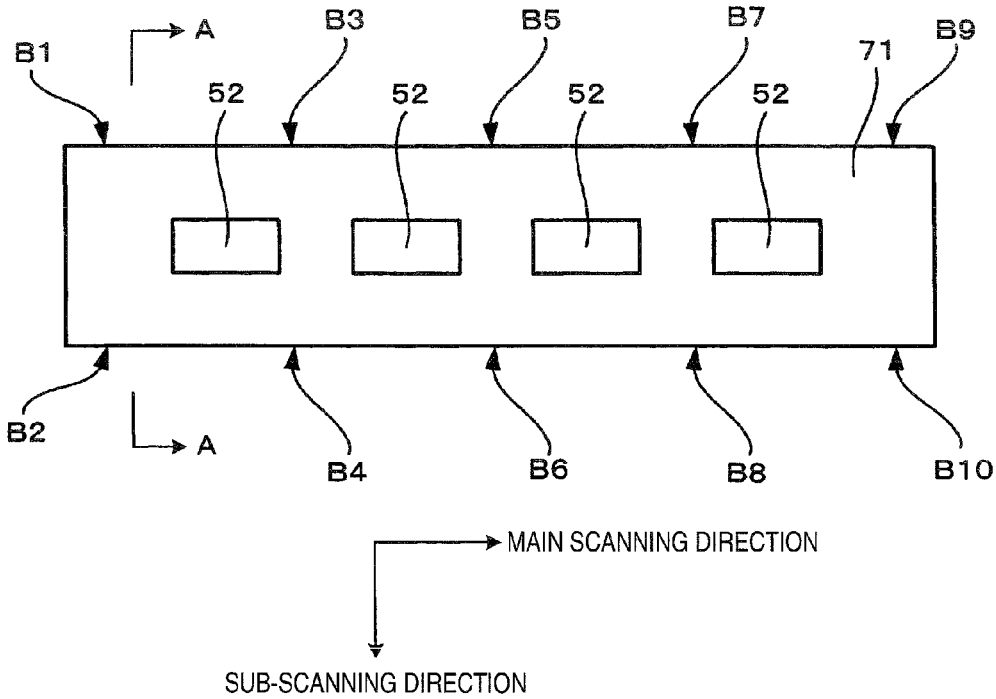
FIG. 2B is a cross-sectional view taken along the line A-A.

FIG. 2A is a cross-sectional view taken along the line A-A of FIG. 2B in a sub-scanning direction, which is a lateral direction of the head 1, and FIG. 2B is a plan view illustrating the head 1 with a COF (chip on film) 50, which is a flat flexible substrate, removed.

As shown in FIGS. 2A and 2B, the head 1 includes a head main body 33 having a flow path unit 9 and an actuator unit 21, a reservoir unit 71 that is provided on the upper surface of the head main body 33 (flow path unit 9) and supplies ink to the head main body 33, and the COF 50 that has one end connected to the actuator unit 21 and includes a driver IC 52 mounted thereon. In this embodiment, the actuator unit 21 is interposed between the flow path unit 9 and the reservoir unit 71 and is provided on the upper surface of the flow path unit 9.

The reservoir unit 71 is a member that supplies ink to the head main body 33 and has an ink flow path (including a reservoir) provided therein. The ink supplied from the ink tank 17 is temporarily stored in the ink flow path of the reservoir unit 71. An opening of the ink flow path is formed in the lower surface of the reservoir unit 71. The opening communicates with an ink supply port 105*b* (see FIG. 3) that is formed in the upper surface of the flow path unit 9. The opening of the ink flow path of the reservoir unit 71 is connected to the flow path unit 9 such that the ink in the reservoir is supplied to the head main body 33 through the ink supply port 105*b*. The reservoir unit 71 is made of a metal material. For example, the reservoir unit 71 may be a laminate of flat metal plates.

The driver IC 52 is fixed to the upper surface of the reservoir unit 71. The driver IC 52 is an electronic circuit part that outputs a driving signal to the actuator unit 21, which will be described below. Four driver ICs 52 are provided so as to correspond to the number of actuator units 21. The four driver ICs 52 are arranged in the main scanning direction at equal intervals. Heat generated during the operation of the driver ICs 52 is transmitted to all the heads 1 through a metal member of the reservoir unit 71, which results in an increase in the temperature of the heads 1.

The COF 50 has one end bonded to the upper surface of the actuator unit 21, and extends in the horizontal direction in the gap between the reservoir unit 71 and the flow path unit 9 along the bonding surface of the actuator unit 21. Then, the COF 50 is bent upward at the lower side of the side surface of the reservoir unit 71 and extends upward along the side surface. Then, the COF 50 is bent to the left side at the upper side of the side surface of the reservoir unit 71 (the upper surface of the reservoir unit 71). As described above, the driver IC 52 is fixed to the upper surface of the reservoir unit 71. The other end of the COF 50 is connected to a control unit 100 over the driver IC 52. The four COFs 50 are provided so as to correspond to four sets of the actuator units 21 and the driver ICs 52.

The actuator units 21 and the driver ICs 52 corresponding to each other are arranged so as to overlap each other in a plan view, and are sequentially connected in one-to-one correspondence with each other in the main scanning direction. That is, the first actuator unit 21 in the main scanning direction is connected to the first driver IC 52 in the main scanning direction. Similarly, the second to fourth actuator units 21 are respectively connected to the second to fourth driver ICs 52 in the main scanning direction.

Figure 3:
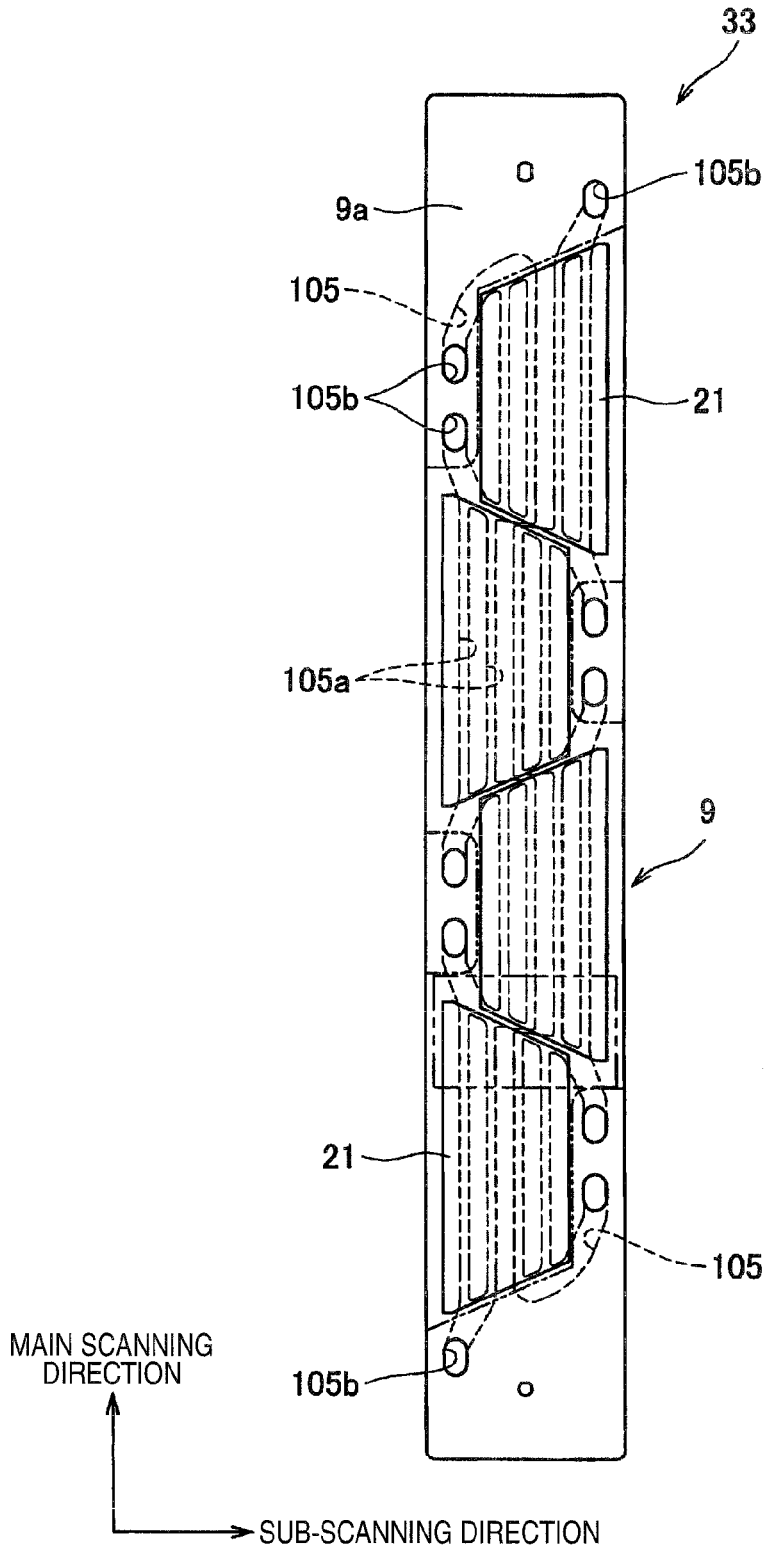
FIG. 3 is a plan view illustrating a head main body shown in FIG. 2.
Figure 4:
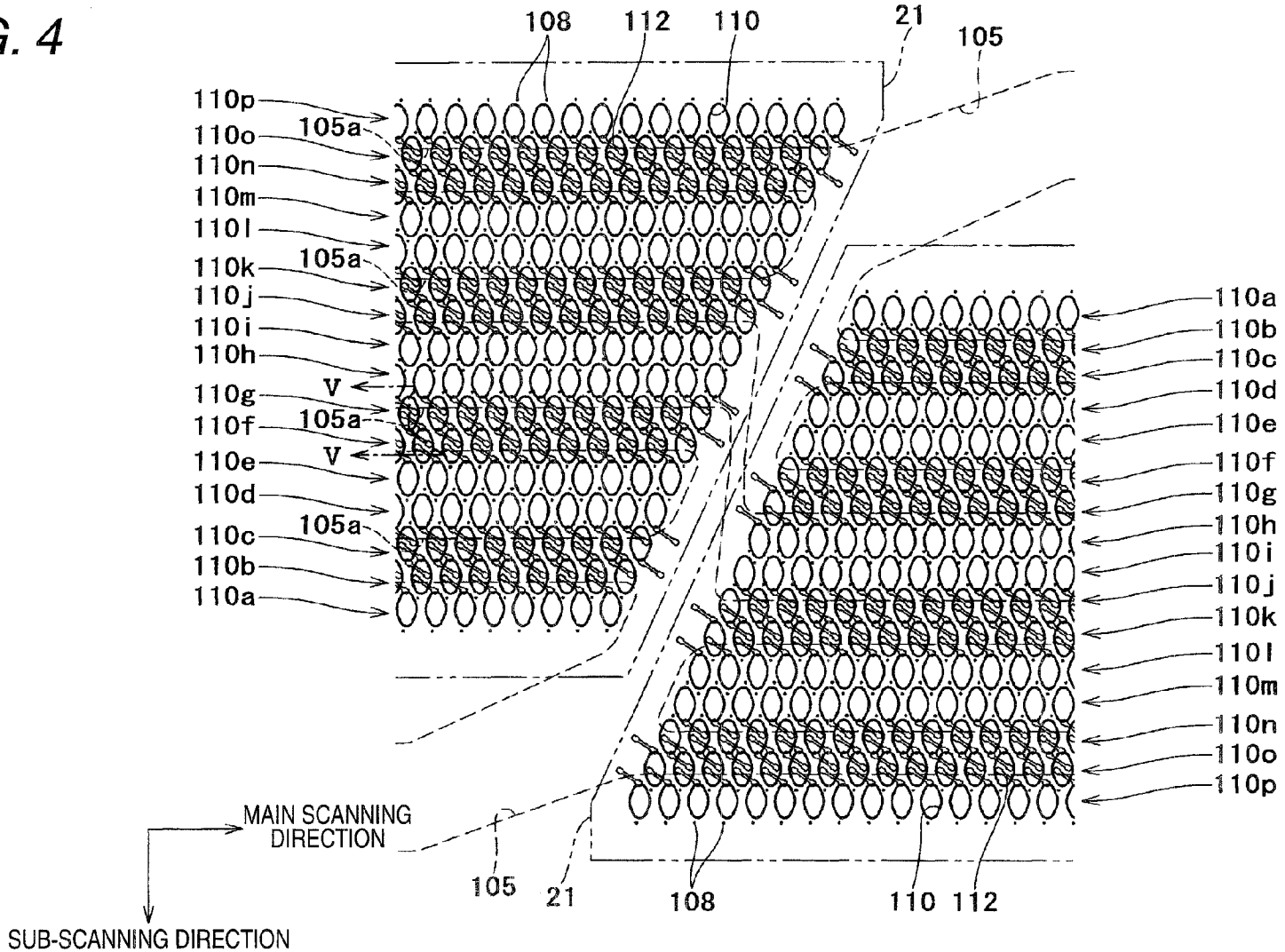
FIG. 4 is an enlarged view illustrating a portion that is laid across two adjacent actuator units 21 shown in FIG. 3.
Figure 5:
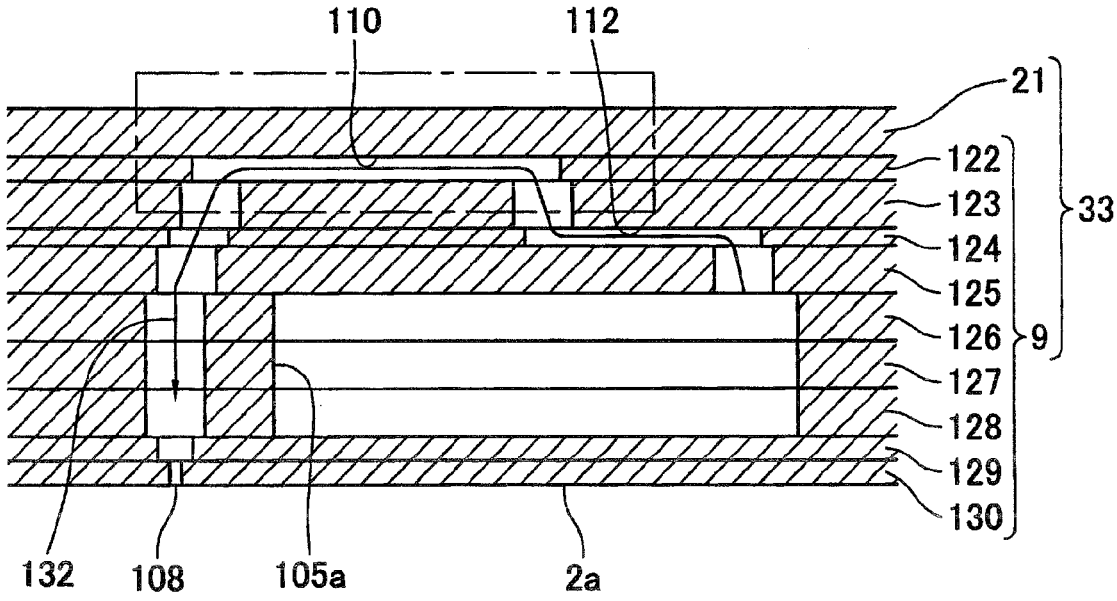
FIG. 5 is a cross-sectional view illustrating a flow path unit taken along the line V-V of FIG. 4.
Figure 6A:
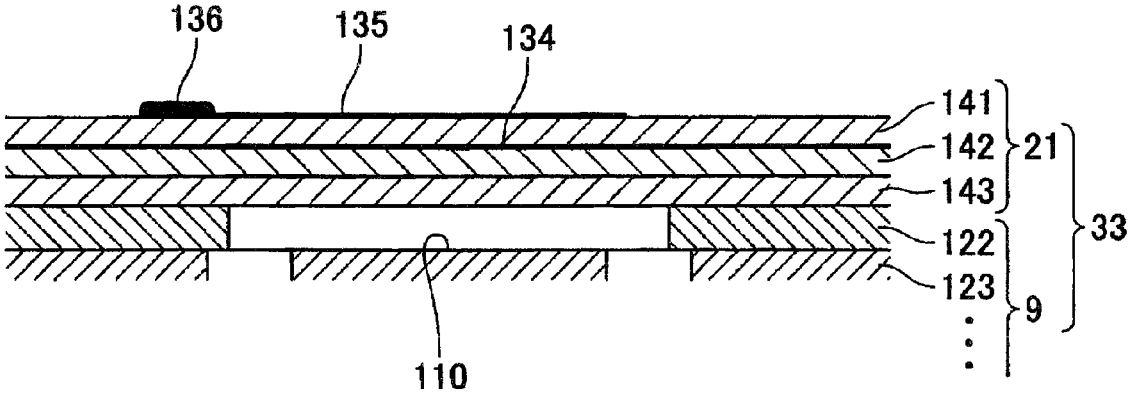
FIG. 6A is an enlarged cross-sectional view illustrating a region represented by a one-dot chain line in FIG. 5.
Figure 6B:
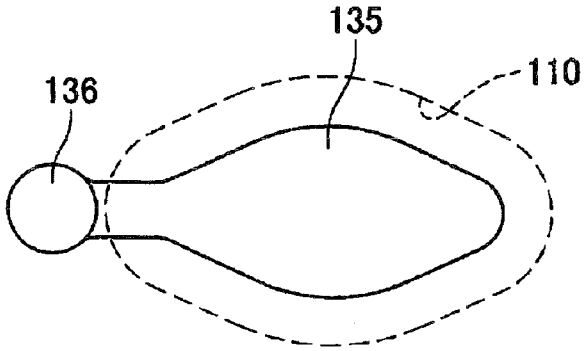
FIG. 6B is a plan view illustrating an individual electrode.

Next, the head main body 33 will be described. FIG. 3 is a plan view illustrating the head main body 33. FIG. 4 is an enlarged view illustrating a portion that is laid across two adjacent actuator units 21 shown in FIG. 3. FIG. 5 is a partial cross-sectional view illustrating the flow path unit 9 taken along the line V-V of FIG. 4. FIG. 6A is an enlarged cross-sectional view illustrating a region represented by a one-dot chain line in FIG. 5 and FIG. 6B is a plan view illustrating an individual electrode. In FIG. 4, for ease of understanding of the drawings, an aperture 112 which should be represented by a dashed line is represented by a solid line.

As shown in FIG. 3, the head main body 33 includes the flow path unit 9 and four actuator units 21 that are fixed to the upper surface 9*a* of the flow path unit 9. As shown in FIG. 4, an ink flow path including, for example, pressure chambers 110 (holes formed in the upper surface 9*a*) is formed in the flow path unit 9. The actuator unit 21 has a trapezoidal shape in a plan view. The actuator unit 21 includes a plurality of actuators corresponding to the pressure chambers 110 and has a function of selectively applying discharge energy to the ink in the pressure chambers 110.

The flow path unit 9 has a rectangular parallelepiped shape in a plan view that is substantially the same as that of the reservoir unit 71. A total of ten ink supply ports 105*b* corresponding to the openings of the ink flow path of the reservoir unit 71 are formed in the upper surface 9*a* of the flow path unit 9. As shown in FIGS. 3 and 4, manifold flow paths 105 communicating with the ink supply ports 105*b* and sub-manifold flow paths 105*a* branched from the manifold flow paths 105 are formed in the flow path unit 9. The manifold flow path 105 extends along an oblique side of the actuator unit 21 having a trapezoidal shape in a plan view. Four sub-manifold flow paths 105*a* extend in the main scanning direction below the actuator unit 21. The four sub-manifold flow paths 105*a* are branched from the manifold flow path 105 on one oblique side of the actuator unit 21, extend in the main scanning direction, and join another manifold flow path 105 on the other oblique side. As shown in FIGS. 4 and 5, a discharge surface 2*a* having a plurality of discharge ports 108 arranged in a matrix is formed on the lower surface of the flow path unit 9.

In this embodiment, sixteen rows of the pressure chambers 110, that is, pressure chamber rows 110*a* to 110*p*, are arranged in parallel to each other at equal intervals in the longitudinal direction (main scanning direction) of the flow path unit 9. The pressure chamber rows 110*a* to 110*p* are arranged such that the number of pressure chambers 110 included in each of the pressure chamber rows 110*a* to 110*p* is gradually reduced from a long side (lower side) to a short side (upper side) so as to correspond to the outward shape (trapezoidal shape) of the actuator unit 21, which will be described below. The discharge ports 108 are arranged in the same way as described above. However, a plurality of rows of the discharge ports 108 is arranged in parallel to each other so as to avoid the sub-manifold flow paths 105*a* in a plan view.

As shown in FIG. 5, the flow path unit 9 includes nine metal plates 122 to 130 made of stainless steel. The plates 122 to 130 are laminated so as to be aligned with each other to form a plurality of individual ink flow paths 132 from the manifold flow path 105 to the discharge ports 108 through the sub-manifold flow paths 105*a*, the outlets of the sub-manifold flow paths 105*a*, and the pressure chambers 110 in the flow path unit 9.

Each of the sub-manifold flow paths 105*a* is linked with a plurality of rows of pressure chambers through the individual ink flow paths 132. For example, among the four sub-manifold flow paths 105*a* passing below one actuator unit 21, the outermost sub-manifold flow path 105*a* in the sub-scanning direction is linked with the pressure chamber rows 110*a* to 110*d*. The second outermost sub-manifold flow path 105*a* is linked with the pressure chamber rows 110*e* to 110*h*. The third outermost sub-manifold flow path 105*a* is linked with the pressure chamber rows 110*i* to 110*l*, and the fourth outermost sub-manifold flow path 105*a* is linked with the pressure chamber rows 110*m* to 110*p*. As such, each of the four sub-manifold flow paths 105*a* is linked with four pressure chamber rows.

The flow of ink in the flow path unit 9 will be described. As shown in FIGS. 3 to 5, the ink supplied from the reservoir unit 71 to the flow path unit 9 through the ink supply ports 105*b* is branched from the manifold flow path 105 to the sub-manifold flow paths 105*a*. The ink in the sub-manifold flow path 105*a* flows into the individual ink flow path 132, and reaches the discharge port 108 through the aperture 112, serving as a diaphragm, and the pressure chamber 110.

Next, the actuator unit 21 will be described. As shown in FIG. 3, the four actuator units 21 have a trapezoidal shape in a plan view and are arranged in a zigzag so as to avoid the ink supply ports 105*b*. In each of the actuator units 21, parallel sides opposite to each other are aligned with the longitudinal direction of the flow path unit 9, and the oblique sides of adjacent actuator units 21 overlap each other in the width direction (sub-scanning direction) of the flow path unit 9.

As shown in FIG. 6A, the actuator unit 21 includes three piezo-electric sheets 141 to 143 made of a ferroelectric lead zirconate titanate (PZT)-based ceramic material. Each of the piezo-electric sheets 141 to 143 is composed of one sheet with a sufficient shape and size to be laid across a plurality of pressure chambers 110. The lower surface of the lowest piezo-electric sheet 143 serves as a fixed surface that is fixed to the flow path unit 9. The upper surface of the uppermost piezo-electric sheet 141 serves as a bonding surface 21*a* that is bonded to the COF 50. The individual electrodes 135 are formed on the bonding surface 21*a* at positions facing the pressure chambers 110. A common electrode 134 is interposed between the uppermost piezo-electric sheet 141 and the piezo-electric sheet 142 below the uppermost piezo-electric sheet 141 so as to be formed on the entire surface of the sheet. As shown in FIG. 6B, the individual electrode 135 has a substantially diamond shape in a plan view that is similar to the shape of the pressure chamber 110. Most of the individual electrode 135 is within the range of the pressure chamber 110 in a plan view. One acute portion of the individual electrode 135 having a substantially diamond shape extends to the outside of the pressure chamber 110, and an individual bump 136 is provided at the leading end of the acute portion so as to be electrically connected to the individual electrode 135 and protrudes from the bonding surface 21*a*. In addition, an individual bump 136 for the common electrode is formed on the bonding surface 21*a* separately from the individual bump 136 for the individual electrode. The common electrode 134 is electrically connected to the individual bump 136 through a conductor that is provided in a through hold formed in the piezo-electric sheet 141.

A constant ground potential is applied to the common electrode 134 in a region corresponding to all the pressure chambers 110. The individual electrode 135 is electrically connected to each output terminal of the driver IC 52 through the COF 50, and is selectively supplied with a driving signal from the driver IC 52.

The piezo-electric sheet 141 is polarized in the thickness direction thereof. When a potential that is different from that applied to the common electrode 134 is applied to the individual electrode 135 and an electric field is applied to the piezo-electric sheet 141 in the polarization direction, a portion of the piezo-electric sheet 141 corresponding to the individual electrode 135 to which the electric field is applied is distorted by a piezo-electric effect and serves as an active portion. That is, the actuator unit 21 includes a plurality of actuators corresponding to the number of pressure chambers 110, and portions interposed between the individual electrodes 135 and the pressure chambers 110 serve as individual actuators. For example, when the polarization direction and the direction in which the electric field is applied are aligned with each other, the active portion is contracted in a direction (plane direction) orthogonal to the polarization direction. As such, the actuator unit 21 is a unimorph type in which one piezo-electric sheet 141 above the pressure chamber 110 is used as a layer including the active portion and two piezo-electric sheets 142 and 143 below the pressure chamber 110 are used as inactive layers. When the electric field is applied, the inactive layer is not spontaneously distorted. As shown in FIG. 6A, the piezo-electric sheets 141 to 143 are fixed to the upper surface of the plate 122 that partitions the pressure chambers 110. Therefore, when there is a difference in distortion between a portion of the piezo-electric sheet 141 to which the electric field is applied and the piezo-electric sheets 142 and 143 below the piezo-electric sheet 141 in the plane direction, all of the piezo-electric sheets 141 to 143 are deformed so as to be convex toward the pressure chamber 110 (unimorph deformation). In this case, discharge energy is applied to the ink in the pressure chamber 110.

Figure 7:
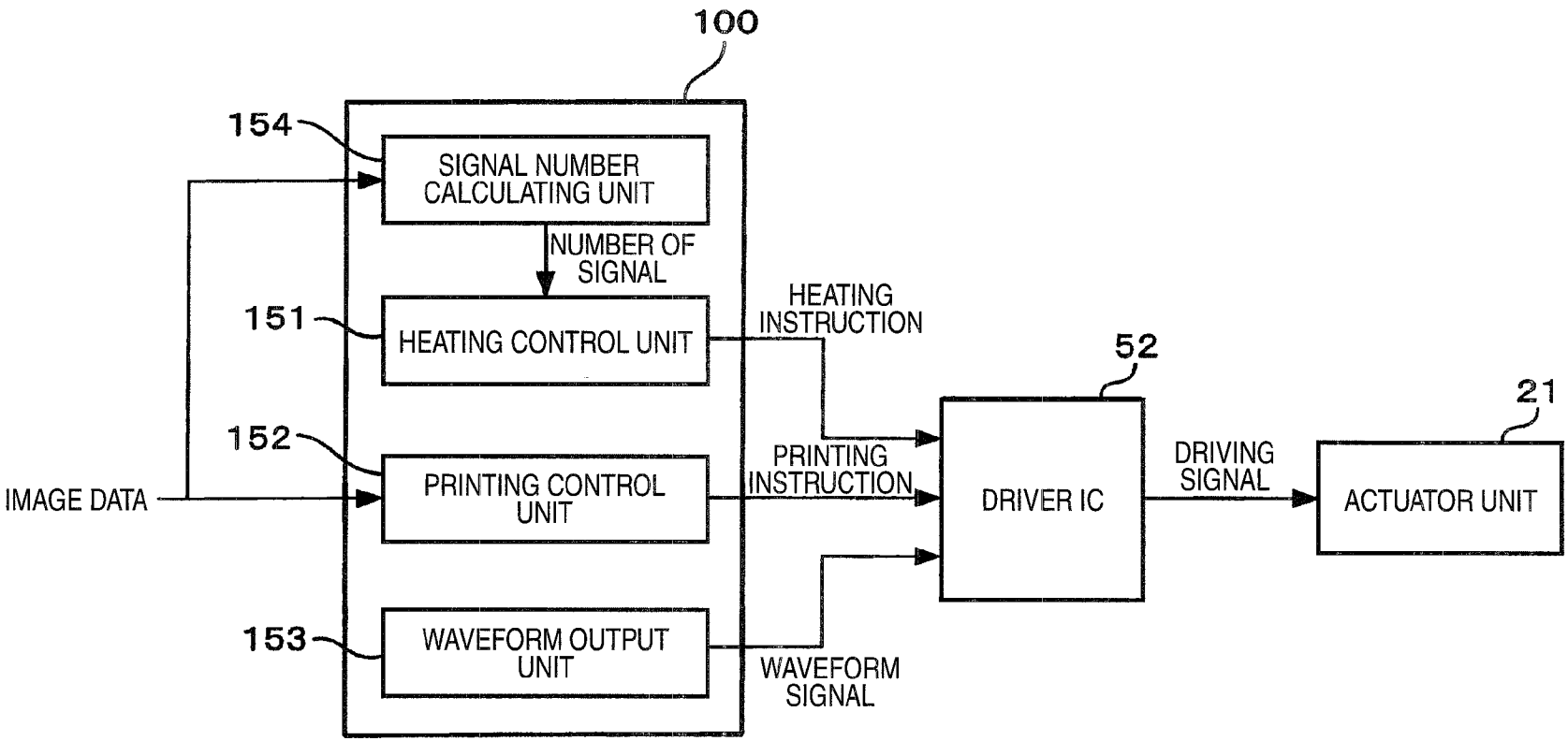
FIG. 7 is a block diagram illustrating a control system of the ink jet printer shown in FIG. 1.

Next, a control system of the ink jet printer 101 will be described in detail with reference to FIG. 7. The control unit 100 includes a CPU (central processing unit), an EEPROM (electrically erasable and programmable read only memory) that rewritably stores programs executed by the CPU and data used for the programs, and a RAM (random access memory) that temporarily stores data when the programs are executed. Functional units of the control unit 100 are constructed by a combination of these hardware components and software in the EEPROM.

The control unit 100 includes a heating control unit 151 and a signal number calculating unit 154. The heating control unit 151 outputs a heating instruction to the driver IC 52 to control the amount of heat generated from the driver IC 52 or the actuator unit 21. In this case, the driver IC 52 outputs a driving signal to the actuator unit 21 in response to the heating instruction. The signal number calculating unit 154 calculates the number of driving signals output from the driver IC 52 to the actuator unit 21 under the control of the heating control unit 151.

The control unit 100 includes a printing control unit 152 that controls a printing process and a waveform output unit 153 that outputs various kinds of waveforms to the driver IC 52. Image data is input from a computer connected to the ink jet printer 101 or a recording medium from which data can be read by the ink jet printer 101 to the printing control unit 152. The printing control unit 152 drives a transport system including the transport mechanism 16, and outputs a printing instruction to the driver IC 52 such that a desired image is formed on a transported printing sheet on the basis of the image data. The waveform output unit 153 outputs waveform signals 161 to 164 shown in FIG. 8 to the driver IC 52.

Figure 8:
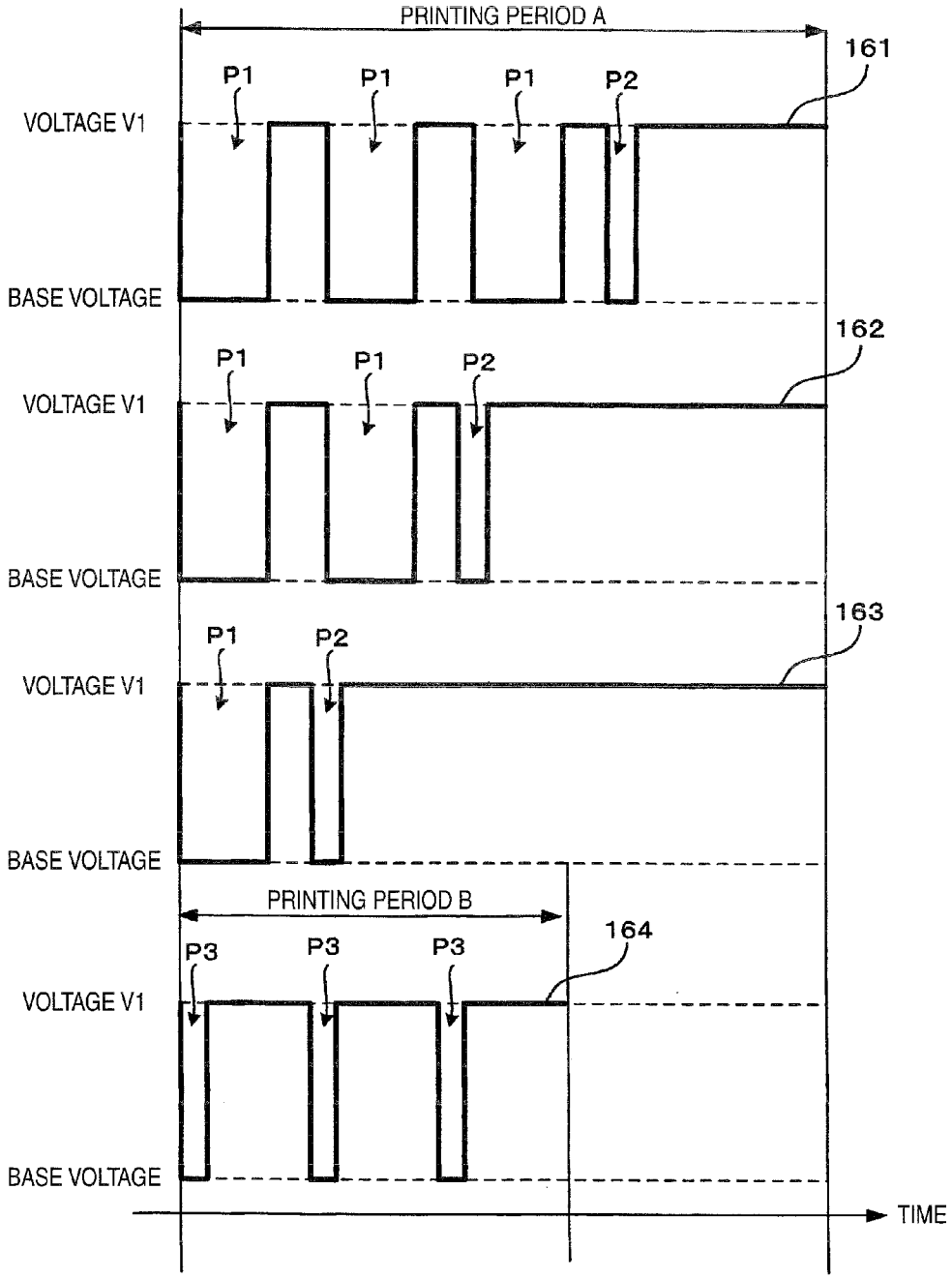
FIG. 8 is a diagram illustrating schematically the waveforms of driving signals supplied to the actuator unit.

The driver IC 52 supplies any one of the waveform signals 161 to 164 from the waveform output unit 153 as a driving signal to the actuator unit 21 in response to a control instruction (for example, the heating instruction or the printing instruction) from the control unit 100. The waveform signals 161 to 163 each include a plurality of square pulses P1 and P2 with a potential difference of V1. In FIG. 8, a base voltage corresponds to a ground potential, which is the potential of the common electrode 134. The waveform signals 161 to 163 each include one to three square pulses P1 and one square pulse P2 arranged immediately after the square pulse P1. The width of the square pulse P2 is about half of that of the square pulse P1. The width of the square pulse P1 is approximately set to an AL length. In this embodiment, the width of the square pulse P1 is 6 μsec.

The square pulse P1 is for driving the actuator unit 21 such that ink is discharged from the discharge port 108. Hereinafter, the square pulse P1 is referred to as a discharge pulse P1. The square pulse P2 (cancel pulse) is a pulse signal that is supplied immediately after the discharge pulse P1 and is for driving the actuator unit 21 so as to control vibration that is generated in the individual ink flow path 132 by the discharge pulse P1. Therefore, the square pulse P2 is a pulse signal for driving the actuator unit 21 such that ink is not discharged from the discharge port 108. Hereinafter, the square pulse P2 is referred to as a non-discharge pulse P2. As such, the non-discharge pulse P2 is supplied immediately after the discharge pulse P1 in order to reduce vibration in the individual ink flow path 132 at the beginning such that the next ink discharging operation is not affected by the vibration.

In the printing instruction from the control unit 100, a continuous series of signals for designating any one of the waveform signals 161 to 163 are temporally arranged. When receiving the printing instruction from the control unit 100, the driver IC 52 supplies one of the waveform signals 161 to 163 designated by the printing instruction to the actuator unit 21 at a predetermined printing period A. In this way, a desired amount of ink is discharged from the discharge port 108, which will be described below. Hereinafter, the waveform signals 161 to 163 are referred to as discharge driving signals 161 to 163. The printing period A corresponds to the time required for the sheet P (recording medium) to be moved a unit distance, which corresponds to the resolution of the sheet P, in the transport direction by the conveyor belt 8.

The waveform signal 164 includes three non-discharge pulses P3 for driving the actuator unit 21 such that ink is not discharged from the discharge port 108. The non-discharge pulse P3 is a square pulse with a potential difference of V1. The non-discharge pulse P3 has a pulse width smaller than that of the square pulse P2. When receiving the heating instruction from the control unit 100, the driver IC 52 continuously supplies a plurality of waveform signals 164 to the actuator unit 21 at each printing period B. Hereinafter, the waveform signal 164 is referred to as a non-discharge driving signal 164. The printing period B is shorter than the printing period A. Therefore, the non-discharge driving signal 164 is supplied to the actuator unit 21 at a driving frequency higher than those of the discharge driving signals 161 to 163. Specifically, the printing period B is shorter than ¾ of the printing period A. When the non-discharge driving signal 164 is continuously supplied, the total number of pulses that can be supplied per unit time is more than that when the discharge driving signal 161 is continuously supplied. Therefore, the amount of heat generated from the driver IC 52 per unit time is increased.

Next, the operation of the actuator unit 21 when the driving signal is supplied from the driver IC 52 will be described. First, in the actuator unit 21, the potential of the individual electrode 135 is maintained such that a potential difference between the individual electrode 135 and the common electrode 134 is V1 (>0) in advance. That is, the piezo-electric sheets 141 to 143 are maintained in a unimorph-deformed state. In this state, all of the piezo-electric sheets 141 to 143 are deformed so as to be convex toward the pressure chamber 110. Therefore, the volume of the pressure chamber 110 is less than that when unimorph deformation does not occur.

In this state, when any one of the discharge driving signals 161 to 163 is supplied from the driver IC 52 to the individual electrode 135, the potential of the individual electrode 135 is changed at once to the ground potential by the discharge pulse P1. Then, when the time corresponding to the width of the discharge pulse P1 has elapsed, the potential difference between the individual electrode 135 and the common electrode 134 returns to V1 again.

In this case, the piezo-electric sheets 141 to 143 return to their original state at the timing when the individual electrode 135 is changed to the ground potential, and the volume of the pressure chamber 110 is increased at once. In this case, negative pressure is generated, and ink is drawn from the manifold flow path 105*a* to the individual ink flow path 132 by the negative pressure. Then, portions of the piezo-electric sheets 141 to 143 facing the active region are deformed so as to be convex toward the pressure chamber 110 again at the timing when the potential difference between the individual electrode 135 and the common electrode 134 is V1, and the volume of the pressure chamber 110 is reduced, which results in an increase in the pressure of the ink. The timing when the potential difference becomes V1 again corresponds to the timing when the drawn ink reaches the pressure chamber 110. In this way, ink is discharged from the discharge port 108. This ink discharge operation is repeated according to the number of discharge pulses P1 included in the discharge driving signals 161 to 163. Therefore, the largest amount of ink is discharged by the discharge driving signal 161, followed by the discharge driving signal 162 and the discharge driving signal 163.

Then, the non-discharge pulse P2 is supplied to the individual electrode 135. The non-discharge pulse P2 is adjusted such that pressure is applied to the pressure chamber 110 at the timing when vibration in the individual ink flow path 132 is reduced (for example, the interval between the non-discharge pulse P2 and the discharge pulse P1 or the width of the non-discharge pulse P2 is adjusted). Therefore, when the non-discharge pulse P2 is supplied to the individual electrode 135, unimorph deformation occurs in the piezo-electric sheets 141 to 143 and pressure is applied to the ink in the pressure chamber 110, similar to the discharge pulse P1. However, the pressure acts so as to prevent a pressure variation in the individual ink flow path 132.

When the non-discharge driving signal 164 is supplied from the driver IC 52 to the individual electrode 135, three non-discharge pulses P3 are supplied to the individual electrode 135 at each period. The non-discharge puke P3 is adjusted such that pressure is applied to, the ink in the pressure chamber 110 at the timing when ink is discharged from the discharge port 108. Therefore, even though unimorph deformation occurs in the piezo-electric sheets 141 to 143, no ink is discharged from the discharge ports 108.

Next, the signal number calculating unit 154 will be described. The signal number calculating unit 154 calculates the number of non-discharge driving signals supplied by the driver IC 52 within a predetermined period under the control of the heating control unit 151. The heating control unit 151 outputs a heating instruction to instruct the driver IC 52 to supply the non-discharge driving signals corresponding to the number of signals calculated by the signal number calculating unit 154.

However, when the head 1 is driven to perform a printing process, the temperature of the head 1 is increased by heat generated from the driver IC 52 or the actuator unit 21. When the temperature of the head 1 varies, the driving conditions of the actuator unit 21 vary or the temperature of ink in the head 1 varies. Therefore, discharge characteristics when ink is discharged from the head 1 vary. That is, when the temperature of the head varies significantly, discharge characteristics, such as the discharge speed of ink from the discharge port 108 or the amount of ink discharged therefrom, vary even though the actuator unit 21 is driven under the same driving conditions. When the discharge characteristics of ink vary, the quality of the image formed on the printing sheet deteriorates.

The signal number calculating unit 154 calculates the number of non-discharge driving signals supplied from the driver IC 52 to the actuator unit 21 such that the quality of the image formed on the printing sheet does not deteriorate. In this case, the number of pulse signals included in the signal supplied from the driver IC 52 to the actuator unit 21 is a standard for calculating the number of signals. Heat is generated from the actuator unit 21 or the driver IC 52 due to a transient current (a charge current and a discharge current) caused by potential variation when the pulse signal is applied. Therefore, heat is generated whenever one pulse signal (the discharge driving signal or the non-discharge driving signal) is supplied from the driver IC 52 to the actuator unit 21 (actuator).

If the same amount of heat is generated each time the transient current flows and the heat is rapidly transmitted, variations in the temperature of the head 1 are controlled. Therefore, it is considered that, due to the control of the heating control unit 151, the number of pulse signals supplied from the driver IC 52 to the actuator unit 21 is maintained at a predetermined value. That is, it is considered that, during a printing process, the heating control unit 151 supplies the non-discharge driving signal to the driver IC 52 according to the number of pulses supplied from the driver IC 52 under the control of the printing control unit 152, thereby maintaining the total number of pulses supplied within a predetermined period at a predetermined value.

However, in this embodiment, when the discharge pulse P1 is supplied to the individual electrode 135, ink is discharged from the discharge ports 108. Therefore, new ink is supplied from the ink tank 17 to the head 1 and the head 1 is cooled down. As such, the temperature of the head 1 varies in different ways when one discharge pulse P1 is supplied and when one non-discharge pulse P2 or P3 is supplied. Therefore, in a control method which simply maintains the total number of discharge pulses and non-discharge pulses at a predetermined value, it is difficult to appropriately control the temperature of the head 1. That is, in the temperature control method, it is necessary to balance the generation of heat due to the application of the pulse signals with the cooling of the head by the discharge of ink.

The signal number calculating unit 154 according to this embodiment calculates the number of non-discharge driving signals supplied from the driver IC 52 to the actuator unit 21 as follows. First, the signal number calculating unit 154 calculates the total number of discharge pulses, which are included in the discharge driving signal supplied from the driver IC 52 to the actuator unit 21 within a predetermined period, on the basis of image data.

Then, the signal number calculating unit 154 calculates the number of non-discharge driving signals supplied from the driver IC 52 to the actuator unit 21 within a predetermined period according to the following equation. In the following equation, N1 indicates the number of discharge pulses supplied during a predetermined period, N2 indicates the number of non-discharge pulses supplied during a predetermined period, a correction coefficient $\alpha$ is a real number satisfying $0<\alpha<1$. The correction coefficient $\alpha$ and a predetermined value are predetermined in order to calculate the number of signals.

$$N1\times\alpha+N2=\text{predetermined value.} \quad \text{(Equation 1)}$$

As such, the signal number calculating unit 154 calculates the number of discharge driving signals such that the sum of a correction number N1×$\alpha$ obtained by multiplying the number N1 of discharge pulses by $\alpha$ and the number N2 of non-discharge pulses is a predetermined value. The heating control unit 151 outputs a heating instruction to instruct the driver IC 52 to supply the number of non-discharge driving signals calculated by the signal number calculating unit 154 within a predetermined period.

For example, when the predetermined value is set to 1000 and $\alpha$ is set to 0.5, it is assumed that the driver IC 52 supplies 100 discharge driving signals 161, 200 discharge driving signals 162, and 50 discharge driving signals 163 within a predetermined period.

In this case, since one to three discharge pulses P1 are included in each of the discharge driving signals 161 to 163, the total number N1 of discharge pulses P1 supplied by the driver IC 52 within a predetermined period is 750 (=100×3+200×2+50×1). The correction number N1×$\alpha$ is 375 (=750×0.5). Meanwhile, since one non-discharge pulse P2 is included in each of the discharge driving signals 161 to 163, the number N2 of non-discharge pulses P2 supplied by the driver IC 52 within a predetermined period is 350 (=100+200+50).

Therefore, according to Equation 1, the number of non-discharge pulses P3 supplied as the non-discharge driving signals within a predetermined period is 275 (=1000-375-350). Since one non-discharge driving signal includes three non-discharge pulses P3, the number of non-discharge driving signals is 92 (=275/3). Therefore, the heating control unit 151 outputs a heating instruction to instruct the driver IC 52 to supply 92 non-discharge driving signals calculated by the signal number calculating unit 154 in the above-mentioned calculation.

The correction coefficient $\alpha$ of Equation 1 is calculated from the amount of heat generated from the driver IC 52 and the actuator unit 21 when one discharge pulse P1 or one non-discharge pulse P2 or P3 is supplied to the actuator unit 21 or the amount of heat dissipated from the head 1 when one discharge pulse P1 is supplied to the actuator unit 21 and ink is discharged from the discharge ports 108. The correction coefficient $\alpha$ may be logically calculated from the amount of heat, or it may be determined from the results when the discharge driving signal or the non-discharge driving signal is supplied to measure variation in the temperature of the head 1. Since heat is generated or dissipated from the head 1 by at least the discharge pulse P1, the correction coefficient $\alpha$ is set to a value of less than 1.

In addition, the predetermined value of Equation 1 may be calculated from the amount of heat required to maintain the temperature of the head 1 to be constant, or it may be set on the basis of the number of pulses required to maintain the temperature of the head 1 to be constant, which is obtained by experiments.

In this embodiment, the above-mentioned heating control process is performed on each of the four sets of the driver ICs 52 and the actuator units 21 connected to each other. Table 1 shows an example of the number of discharge driving signals 161 to 163 supplied to each of the four actuator units 21 (A to D in Table 1) within a predetermined period. When the correction coefficient $\alpha$ of Equation 1 is 0.5, the number of discharge pulses P1, the correction number thereof, and the number of non-discharge pulses P2 are calculated from the conditions of Table 1, as shown in Table 2. When the predetermined value of Equation 1 is determined to be 1000 in each of the actuator units 21, the number of non-discharge pulses P3 supplied to the actuator unit 21 is calculated as shown in Table 2.

TABLE 1

| Actuator unit | A | B | C | D |
|---|---|---|---|---|
| Discharge driving signal 161 | 100 | 100 | 10 | 50 |
| Discharge driving signal 162 | 200 | 20 | 40 | 150 |
| Discharge driving signal 163 | 50 | 10 | 50 | 200 |

TABLE 2

| Actuator unit | A | B | C | D |
|---|---|---|---|---|
| Discharge pulse P1 (N1) | 750 | 350 | 160 | 650 |
| Correction coefficient ($\alpha$) | 0.5 | 0.5 | 0.5 | 0.5 |
| Correction number (N1 × $\alpha$) | 375 | 175 | 80 | 325 |
| Non-discharge pulse P2 | 350 | 130 | 100 | 400 |
| Non-discharge pulse P3 | 275 | 695 | 820 | 275 |
| Predetermined value | 1000 | 1000 | 1000 | 1000 |

As shown in Table 1 and Table 2, when the correction coefficient $\alpha$ is 0.5, the discharge pulse less contributes to the generation of heat. When the same predetermined value is set to the actuator units 21, it is possible to maintain the amount of heat generated from each of the four sets of the driver ICs 52 and the actuator units 21 to be substantially constant. Therefore, it is possible to remove differences in the amount of heat among the four sets and thus prevent differences in the temperature of the heads 1.

Alternatively, in order to minimize the total amount of heat generated from the driver IC 52 and the actuator unit 21 and avoid an excessive increase in the temperature of the head 1, the predetermined value may be set to the maximum of the sum of the correction number (N1×$\alpha$) of the discharge pulse P1 and the number of non-discharge pulses P2. Table 3 shows an example in which a predetermined value of 725 is set to the actuator units A and D having the maximum sum of the correction number (N1×$\alpha$) of the discharge pulse P1 and the number of non-discharge pulses P2 under the condition of Table 1. The correction coefficient $\alpha$ is also 0.5. In this case, the correction coefficient may be calculated logically or by experiments, considering the amount of heat generated or dissipated from the head 1, in order to make the temperature of the head 1 constant.

TABLE 3

| Actuator unit | A | B | C | D |
|---|---|---|---|---|
| Discharge pulse P1 (N1) | 750 | 350 | 160 | 650 |
| Correction coefficient ($\alpha$) | 0.5 | 0.5 | 0.5 | 0.5 |

TABLE 3-continued

| Actuator unit | A | B | C | D |
|---|---|---|---|---|
| Correction number (N1 × α) | 375 | 175 | 80 | 325 |
| Non-discharge pulse P2 | 350 | 130 | 100 | 400 |
| Non-discharge pulse P3 | 0 | 420 | 545 | 0 |
| Predetermined value | 725 | 725 | 725 | 725 |

Figure 9:
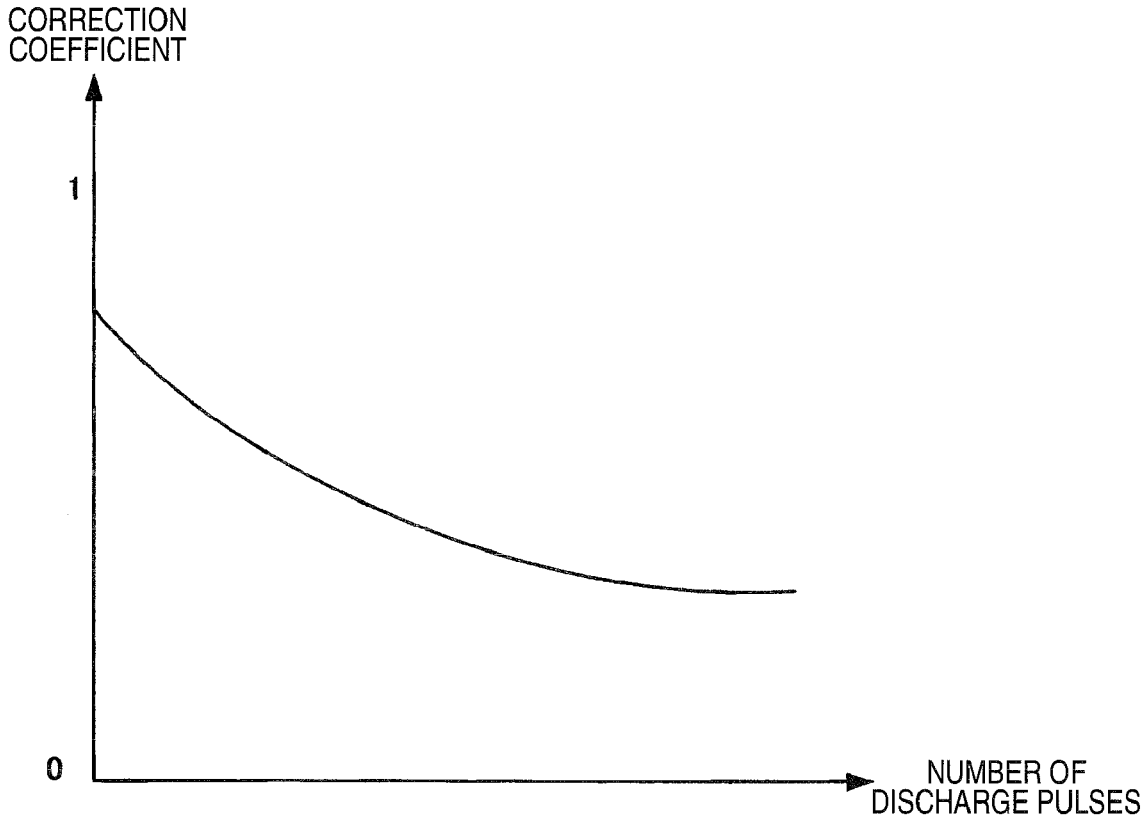
FIG. 9 is a graph illustrating the relationship between a correction coefficient $\alpha$ and the number of discharge pulses used for the heating control of the ink jet head.

The above-mentioned example corresponds to a case in which the number of non-discharge pulses P3 supplied to each of the actuator units 21 may be calculated using a constant correction coefficient α. However, the correction coefficient α may vary depending on the content of the printing process or the surrounding environment of the head 1. For example, FIG. 9 shows a case in which the correction coefficient α is reduced according to the number of discharge pulses. As such, the correction coefficient α may be decreased as the number of discharge pulses is increased, which is deduced from the following experimental results.

Figure 10:
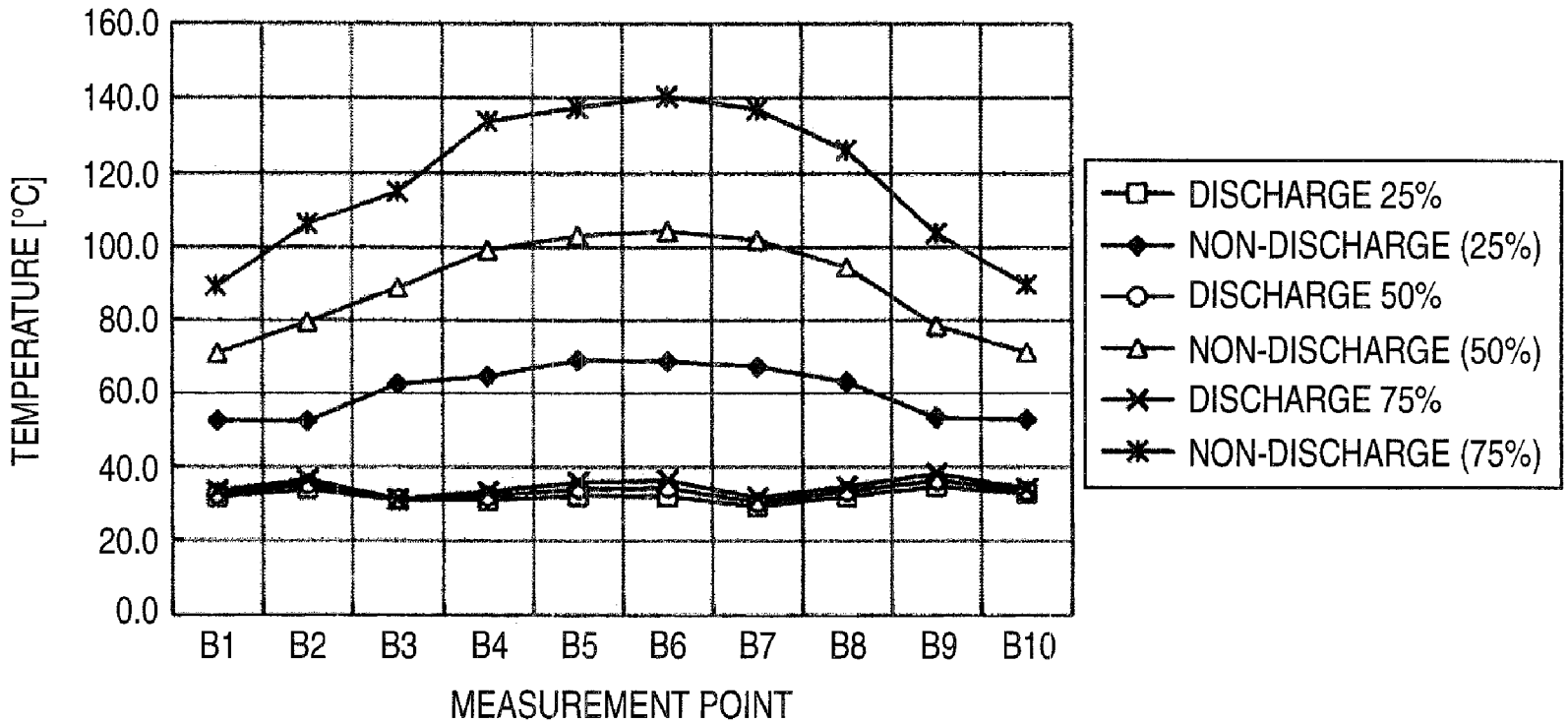
FIG. 10 is a graph illustrating the temperature of the head detected at each point after driving signals are supplies with various duties.

FIG. 10 is a graph illustrating the temperature of the head 1 when the discharge driving signal 161 is supplied to the actuator unit 21 of the head 1 according to an embodiment with various duties and the temperature of the head 1 when the non-discharge driving signal 164 is supplied to the actuator unit 21 of the head 1 with various duties. The temperature of the head 1 is measured at points represented by arrows B1 to B10 in FIG. 2B on the side surface of the head main body 33 in a plan view. In addition, in this embodiment, if a duty when the number of pulses supplied per unit time is the maximum is 100%, the discharge driving signal 161 or the non-discharge driving signal 164 is supplied to the actuator unit 21 with duties of 25%, 50%, and 75%. These duties are adjusted such that, when the duties are equal to each other, the amount of heat generated from the actuator unit 21 and the driver IC 52 when the discharge driving signal 161 is supplied is equal to that when the non-discharge driving signal 164 is supplied. In the experiments of the duties, the initial temperatures of the head 1 have the same value.

As shown in FIG. 10, when the non-discharge driving signal 164 is supplied, the temperature of the head 1 is increased substantially in direct proportion to the duty. On the other hand, when the discharge driving signal 161 is supplies, the temperature of the head 1 hardly varies depending on the duty. This shows that, even when there is an increase in the number of discharge pulses P1 supplied, variation in the temperature of the head 1 is less affected by the increase in the number of discharge pulses P1 than that when the number of non-discharge pulses P3 supplied is increased. Therefore, in this case, if the correction coefficient α is maintained to be constant, the contribution of the discharge pulse P1 to the temperature variation is estimated to be excessively large in response to an increase in the number of discharge pulse P1 supplied.

From the above-mentioned experimental results, as shown in FIG. 9, the correction coefficient α decreases as the number of discharge pulses P1 supplied is increased. In this way, it is possible to appropriately estimate the contribution of the discharge pulse P1 to an increase in temperature according to the number of discharge pulses P1 supplied. As such, the correction coefficient α may be set such that the contribution of the discharge pulse to temperature variation is changed relative to the contribution of the non-discharge pulse to temperature variation, thereby maintaining the temperature of the head 1 to be constant.

Table 4 shows a case in which the correction coefficient α is set to 0.28, 0.4, 0.7, and 0.3 according to the number of discharge pulses P1 supplied to the actuator units 21 (A to D). The signal number calculating unit 154 stores a table or a function in which the number of discharge pulses and the correction coefficient α are associated with each other, and sets the correction coefficient α to an appropriate value from the number of discharge pulses P1 on the basis of the table or the function. Then, as shown in Table 4, the signal number calculating unit calculates the number of non-discharge pulses P3 and calculates the number of non-discharge driving signals 164 supplied to the actuator unit 21.

TABLE 4

| Actuator unit | A | B | C | D |
|---|---|---|---|---|
| Discharge pulse P1 (N1) | 750 | 350 | 160 | 650 |
| Correction coefficient (α) | 0.28 | 0.4 | 0.7 | 0.3 |
| Correction number (N1 × α) | 210 | 140 | 112 | 195 |
| Non-discharge pulse P2 | 350 | 130 | 100 | 400 |
| Non-discharge pulse P3 (N2) | 440 | 730 | 788 | 405 |
| Predetermined value | 1000 | 1000 | 1000 | 1000 |

Figure 11:
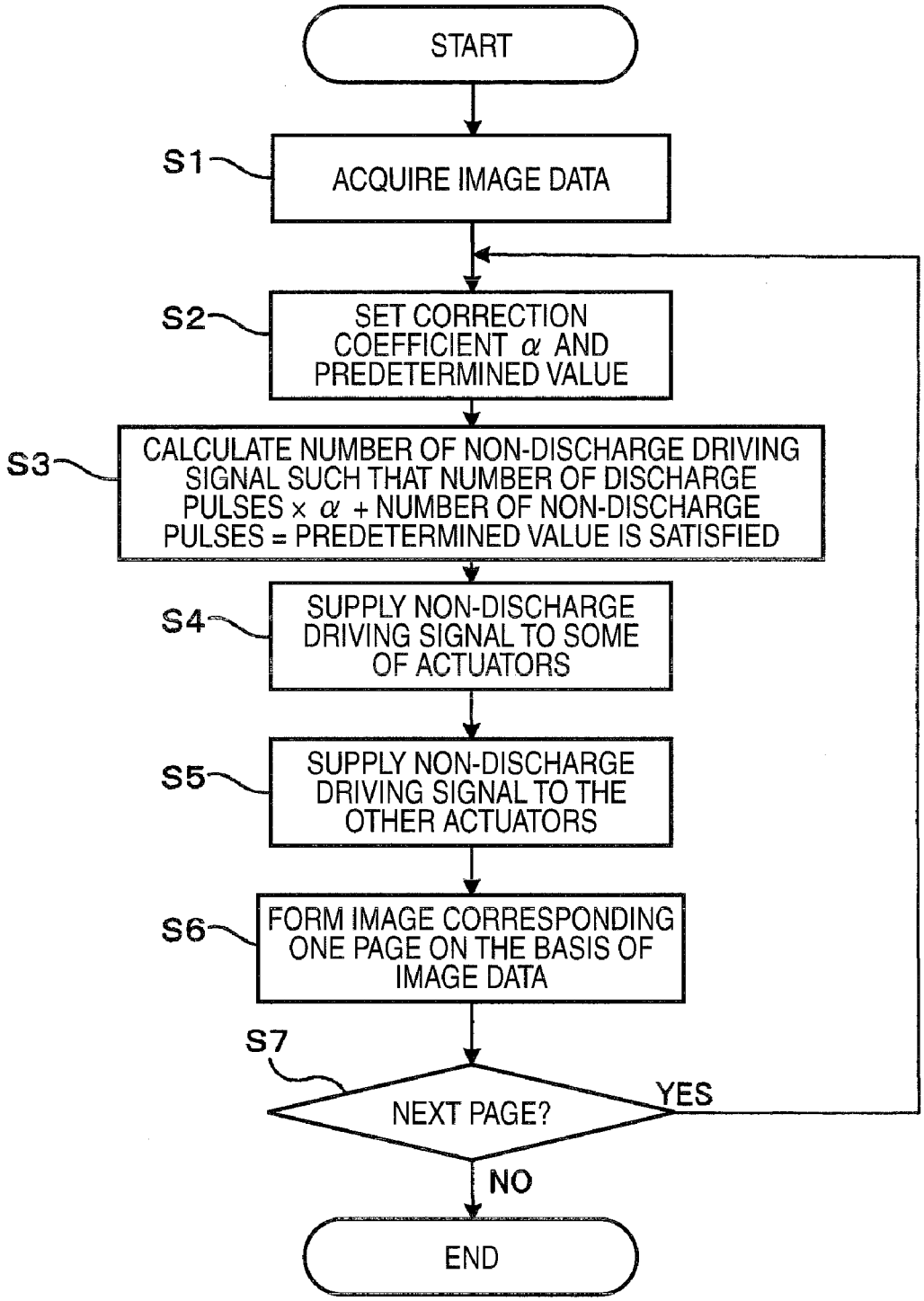
FIG. 11 is a flowchart illustrating a series of processes performed by a control unit shown in FIG. 1.

Next, the process content of the control unit 100 will be described in detail. FIG. 11 shows an example of a flowchart illustrating a series of processes performed by the control unit 100. First, when the ink jet printer 101 acquires image data from, for example, an external PC (S1), the signal number calculating unit 154 sets the correction coefficient α and the predetermined value of Equation 1 on the basis of the image data (S2). For example, the correction coefficient α and the predetermined value are set to the values shown in Tables 2 to 4.

Then, the signal number calculating unit 154 calculates the number of non-discharge driving signals supplied to the actuator unit 21 so as to satisfy Equation 1 (S3). Specifically, the signal number calculating unit 154 calculates the number of non-discharge driving signals from the conditions shown in Table 1 as shown in Tables 2 to 4. In the example shown in FIG. 11, a predetermined period, which is a standard for calculating the number of discharge pulses P1 or non-discharge pulses P2, is a period from the formation of an image on one page of the printing sheet to the formation of an image on the next page of the printing sheet. The period includes a period (non-discharge period) for which no image is formed from the end of the formation of an image corresponding to one page to the start of the formation of an image corresponding to the next page. That is, in the period from the formation of an image on one page of the printing sheet to the formation of an image on the next page of the printing sheet, the number of non-discharge driving signals is calculated such that the total number of discharge pulses P1 or non-discharge pulses P2 or P3 satisfies Equation 1.

Then, the heating control unit 151 controls the driver IC 52 to supply the number of non-discharge driving signals calculated in Step S3 by the signal number calculating unit 154 to the actuator unit 21 (S4 and S5). In this case, the heating control unit 151 supplies the non-discharge driving signals to only some of a plurality of actuators included in each of the actuator units 21 (S4) and then supplies the non-discharge driving signals to the other actuators (S5). The heating control unit 151 supplies the non-discharge driving signals such that the total number of non-discharge driving signals supplied in Steps S4 and S5 is equal to the number of non-discharge driving signals calculated in Step S3 by the signal number calculating unit 154.

Specifically, the heating control unit 151 supplies the non-discharge driving signals to the individual electrodes 135 corresponding to some of the pressure chamber rows that extend along each sub-manifold flow path 105*a*, and then supplies the non-discharge driving signals to the individual electrodes 135 corresponding to the other pressure chamber rows. For example, in Step S4, the heating control unit 151 supplies the non-discharge driving signals to every second pressure chamber row in the sub-scanning direction, that is, the pressure chamber rows 110*a*, 110*c*, 110*e*, . . . , 110*m*, and 110*o* and then supplies the non-discharge driving signals to the remaining pressure chamber rows 110*b*, 110*d*, 110*f*, . . . , 110*n*, and 110*p* (see FIG. 4). In this way, a plurality of pressure chamber rows is divided into two groups of every second pressure chamber row and the non-discharge driving signals are supplied to one group of pressure chamber rows and the other group of pressure chamber rows at different times.

As such, the non-discharge driving signals are not supplied to all the actuators at the same time, but are supplied to two groups of actuators at different times. In this way, it is possible to prevent a crosstalk phenomenon occurring when the non-discharge driving signals are supplied to all the actuators at the same time.

In particular, the crosstalk phenomenon is likely to occur between adjacent pressure chamber rows, and ink is discharged by the non-discharge driving signals even though the non-discharge driving signals do not discharge ink. Therefore, as described above, when the pressure chamber rows linked with the sub-manifold flow path 105*a* are divided into a plurality of groups and the non-discharge driving signals are sequentially supplied to the divided groups of the pressure chamber rows, it is possible to effectively prevent the structural crosstalk between the pressure chamber rows linked with the common sub-manifold flow path 105*a*. In addition, since the pressure chamber rows are divided into two groups, it is possible to reduce the time required to supply signals to the two divided groups, as compared to when the pressure chamber rows are divided into three or more groups and the three or more groups of the pressure chamber rows are driven at different times. In addition, it is possible to prevent a reduction in temperature during the supply of the signals.

Then, the printing control unit 152 outputs a printing instruction to the driver IC 52 on the basis of image data to form an image on one page of the printing sheet (S6). Then, the control unit 100 determines whether there is a print job for the next page (S7). If it is determined that there is a print job for the next page (S7, Yes), the control unit 100 repeatedly performs the process after Step S2 on the basis of image data of the next page. On the other hand, if it is determined that there is no print job for the next page (S7, No), the control unit 100 ends a series of processes.

According to this embodiment, the number of pulses included in the driving signal supplied from the driver IC 52 to the actuator unit 21 is controlled to be a predetermined value. In this way, the temperature of the head 1 is controlled. Therefore, it is possible to appropriately control the temperature of the head in advance according to temperature variation, as compared to when the temperature of the head is controlled on the basis of the detected temperature. In addition, the total number of discharge pulses and non-discharge pulses is not controlled to be a predetermined value, but the correction number, which is estimated to reduce the number of discharge pulses, is used. Therefore, it is possible to more appropriately perform temperature control.

In the process shown in FIG. 11, during the ink non-discharge period from the end of the printing of an image corresponding to one page to the start of the printing of an image corresponding to the next page, the non-discharge driving signal 164 is supplied to the actuator unit 21. Therefore, it is possible to prevent the formation of an image from being adversely affected by, for example, crosstalk caused by the supply of the non-discharge driving signal, as compared to when the non-discharge driving signal is supplied during the period for which the head 1 discharges ink (during the formation of an image).

When the non-discharge driving signal 164 is supplied from the driver IC 52 to the actuator unit 21, the driving signal is supplied at a driving frequency higher than that when the discharge driving signals 161 to 163 are supplied and the total number of pulses supplied per unit time is increased. In this way, when the non-discharge driving signal 164 is supplied, it is possible to supply a predetermined number of non-discharge pulses P3 in a short time. Therefore, it is possible to transport the sheet P at a high speed and rapidly increase the temperature of the head. In particular, after a purging process, this is effective immediately after the temperature of the head has been reduced. The purging process discharges ink from the discharge ports 108 and restores and maintains the ink discharge characteristics of the discharge ports 108, in which a large amount of ink is discharged in a short period of time. Therefore, in many cases, the temperature of the head is significantly reduced after the purging process, and it is preferable to supply the non-discharge driving signal 164 at a maximum driving frequency after the purging process.

<Modifications>

The exemplary embodiment of the invention has been described above, but the invention is not limited thereto. Various modifications of the invention can be made without departing from the scope of the invention described in the Means for Solving the Problem.

For example, in the above-described embodiment, the pressure chamber rows are divided into a plurality of groups, and a non-discharge driving process is sequentially performed on the divided groups. However, the non-discharge driving process that is sequentially performed may be repeated a plurality of times to complete a series of non-discharge driving processes.

In the above-described embodiment, it is assumed that the correction coefficient $\alpha$ (FIG. 9) is decreased as the number of discharge pulses is increased. The reason is that, as shown in FIG. 10, even when the number of discharge pulses P1 supplied is increased, variation in the temperature of the head 1 is less affected by the increase in the number of discharge pulses P1 than that when the number of non-discharge pulses P3 supplied is increased. In this case, as described above, as the number of discharge pulses P1 supplied is increased, the correction coefficient $\alpha$ is decreased such that the contribution of the discharge pulse P1 to temperature variation is estimated to be not excessively large.

An embodiment is considered in which, when the number of discharge pulses P1 supplied is increased, variation in the temperature of the head 1 is more than that when the number of non-discharge pulses P3 supplied is increased, according to the property of ink. In this case, when the correction coefficient $\alpha$ is maintained at a constant value regardless of the number of discharge pulses P1 supplied, the contribution of the discharge pulse P1 to temperature variation is estimated to be excessively small as the number of discharge pulse P1 supplied is increased. Therefore, in the embodiment operated contrary to the above-described embodiment, the correction coefficient $\alpha$ needs to be increased as the number of discharge pulses is increased.

For example, as ink having the above-mentioned property, there is a solid ink that is in a solid state at a room temperature (20° C.) and is heated to a temperature of about 100° C. and melted to be used. In a hot melt type head 1 corresponding to the ink, the temperature of ink flowing into the head is likely to be higher than the driving temperature of the head. In this case, when the number of discharge pulses is increased, the correction coefficient is increased. In addition, in this case, the main object of the driving of the actuator by the non-discharge driving signal is to stir the melted ink or prevent a change in the property of the ink, not to adjust the temperature of the head 1 that has been cooled.

In the process shown in FIG. 11, the number of discharge pulses P1 and non-discharge pulses P2 supplied to the actuator unit 21 in a one-page printing process is considered and the non-discharge driving signal 164 is supplied before the printing process corresponding to one page is performed. However, the non-discharge driving signal 164 may be performed after the printing process corresponding to one page has been performed.

In the process shown in FIG. 11, during the period from the printing of one page to the printing of the next page, the non-discharge driving signal 164 is supplied to the actuator unit 21. However, the non-discharge driving signal 164 may be supplied to some actuators that are not driven during a printing process, among a plurality of actuators included in the actuator unit 21, until the next driving period of the actuators. In this case, a predetermined period, which is a standard for satisfying Equation 1, may be set to be within a one-page printing period.

In the above-described embodiment, the predetermined value, which is a reference value of the total number of pulses, is constant. However, the predetermined value may vary depending on conditions. For example, as the number of printed pages is increased, the predetermined value may be decreased. In this way, the temperature of the head 1 does not increase continuously, but is maintained at a desired value. Alternatively, a temperature sensor may be used to detect the temperature of the head 1 and the predetermined value may vary according to the detection result of the temperature sensor. In addition, the correction coefficient $\alpha$ may be corrected according to the detection result of the temperature sensor. In these cases, the correction coefficient $\alpha$ is set to a small value such that a large amount of heat is generated at a low temperature. In this way, it is possible to rapidly adjust the temperature of the head 1 to a desired temperature.

In the above-described embodiment, the discharge pulse P1 and the non-discharge pulses P2 and P3 have the same potential difference, V1. The number of discharge pulses P1 in each of the discharge driving signals 161 to 163 is changed such that different amounts of ink are discharged. However, the voltage of the pulse may vary to change the amount of ink discharged. In this case, it is considered that, even when the same number of pulses is supplied, different amounts of heat are generated from the driver IC 52. Therefore, when the method of changing the amount of ink discharged using the pulse voltage is used, the correction coefficient $\alpha$ of Equation 1 needs to be corrected by the actual amount of ink discharged. That is, the correction coefficient $\alpha$ needs to be corrected such that, even when the number of discharge pulses supplied during a predetermined period is constant, the correction coefficient $\alpha$ is decreased as the number of discharge pulses for discharging a large amount of ink is increased. In FIG. 9, the correction coefficient $\alpha$ is decreased according to the number of discharge pulses. In this case, similarly, when the method of adjusting the amount of ink discharged using the pulse voltage is used, it is not preferable to decrease the correction coefficient $\alpha$ according to the number of discharge pulses. In FIG. 9, the correction coefficient $\alpha$ needs to be decreased as the amount of ink discharged is increased.

In this embodiment, the correction coefficient $\alpha$ is determined so as to have a predetermined relationship to the number of discharge pulses (for example, the relationship shown in FIG. 9). However, a correction based on the arrangement position of the actuator unit 21 may be added. As shown in FIG. 10, even when the same number of non-discharge pulses is applied, the temperature of the center of the head is likely to be higher than that at both ends. For example, even when the same number of discharge pulses is applied, the correction coefficient for two actuator units 21 arranged at both sides is smaller than that for two actuator units 21 arranged at the center. As such, the contribution of the discharge pulse to temperature variation may be estimated to be lower at the center than at both sides.

In the above-described embodiment, the invention is applied to the ink jet head that discharges ink from nozzles, but the invention is not limited to the ink jet head. For example, the invention may be applied to liquid droplet discharging heads that discharge conductive paste onto a substrate to form a fine pattern on the substrate, discharge an organic luminescent material onto a substrate to form a high-resolution display, or discharge an optical resin onto a substrate to form, for example, a microelectronic device, such as an optical waveguide.

In this embodiment, the piezo-electric actuator is used. However, actuators of an electrostatic type or a resistance heating type may be used.

According to a first aspect of the present invention, there is provided a recording apparatus comprising: a recording head that comprises: a discharge port through which a liquid is discharged; an actuator that discharges the liquid from the discharge port; and a driving circuit that selectively supplies to the actuator a discharge driving signal, which includes at least one of discharge pulse signals and is used to drive the actuator so as to discharge the liquid from the discharge port, and a non-discharge driving signal, which includes at least one of non-discharge pulse signals and is used to drive the actuator so as not to discharge the liquid from the discharge port, a transport unit that transports a recording medium to a position facing the recording head; an image recording control unit that controls the actuator to discharge the liquid onto the recording medium transported by the transport unit on the basis of image data; a signal number calculating unit that calculates the number of non-discharge driving signals supplied from the driving circuit to the actuator on the basis of the image data; and a non-discharge driving control unit that controls the driving circuit to supply the number of non-discharge driving signals calculated by the signal number calculating unit, wherein the signal number calculating unit calculates the number of non-discharge driving signals such that the sum of the number of correction pulses for correcting the total number of discharge pulse signals supplied to the actuator within a predetermined period to be reduced and the total number of non-discharge pulse signals supplied to the actuator within the predetermined period is equal to a predetermined value.

According to the recording apparatus of the first aspect of the invention, the temperature of the head is controlled by making the number of pulses supplied from the driving circuit to the actuator equal to a predetermined value. Therefore, it is possible to appropriately perform temperature control in response to temperature variation, as compared to the structure in which the temperature of the head is controlled on the basis of the detected temperature. In addition, when the liquid is discharged from the discharge port, the recording head is cooled by liquid supplied to the recording head. However, in the invention, the number of correction pulses, which is estimated to reduce the total number of discharge pulse signals included in the discharge driving signal, is used. Therefore, it is possible to control the temperature of the head, appropriately considering the amount of liquid discharged from the discharge port, by making the sum of the number of correction pulses and the number of pulse signals included in the non-discharge driving signal equal to a predetermined number.

The 'predetermined value' is predetermined when the signal number calculating unit calculates the number of non-discharge driving signals. The 'predetermined value' may be a fixed value or a value calculated according to a certain standard before the number of non-discharge driving signals is calculated. For example, the 'predetermined value' may be predetermined according to the amount of heat in order to maintain the amount of heat generated from, for example, the driving circuit to be constant all the time.

According to a second aspect of the present invention, in addition to the first aspect of the invention, the number of non-discharge driving signals is calculated such that a ratio of the number of correction pulses to the total number of discharge pulse signals supplied to the actuator within the predetermined period varies depending on the total amount of liquid discharged from the discharge port within the predetermined period.

Even when the total amount of liquid discharged from the discharge port is changed, in some cases, the contribution of the discharge pulse to variation in the temperature of the recording head is estimated to be excessively large or small when the correction coefficient is maintained to be constant. As described above, it is possible to appropriately estimate the degree of the discharge pulse to temperature variation by changing the correction coefficient according to the amount of liquid discharged from the discharge port.

According to a third aspect of the present invention, in addition to the first aspect of the present invention, the image recording control unit repeatedly performs a first image recording process of recording an image on the recording medium, and the non-discharge driving control unit controls the driving circuit to supply the non-discharge driving signals to the actuator during a non-discharge period, which is a period from the end of the first image recording process to the start of a second image recording process that is the next process of the first image recording process.

According to the above-mentioned structure, the non-discharge driving signal is supplied during the non-discharge period in the image recording process. Therefore, it is possible to prevent the discharge of the liquid from being affected by the supply of the non-discharge driving signal.

According to a fourth aspect of the present invention, in addition to the third aspect of the present invention, the number of non-discharge pulse signals per unit time supplied from the driving circuit to the actuator during the non-discharge period is more than the total number of discharge pulse signals and non-discharge pulse signals per unit time supplied from the driving circuit to the actuator in the first image recording process.

According to the above-mentioned structure, the number of pulse signals supplied per unit time during the non-discharge period is more than the number of pulse signals supplied per unit time during the image recording process. Therefore, it is possible to reduce the length of the non-discharge period required to supply a predetermined number of pulse signals.

According to a fifth aspect of the present invention, in addition to the fourth aspect of the invention, the non-discharge driving control unit controls the driving circuit to supply the non-discharge driving signal to the actuator during the non-discharge period at a driving frequency higher than that of the discharge driving signal supplied to the actuator in the first image recording process.

According to the above-mentioned structure, it is possible to increase the temperature of the head in a short time. In particular, this is effective immediately after the temperature of the head has been reduced after a purging process. After the purging process, the non-discharge driving signal may be supplied at a high driving frequency.

According to a sixth aspect of the present invention, in addition to the third aspect of the present invention, the predetermined period includes the non-discharge period and a period for which the first image recording process is performed before or after the non-discharge period.

According to the above-mentioned structure, it is possible to perform temperature control for each period for which an image is recorded on one recording medium.

According to a seventh aspect of the present invention, in addition to the first aspect of the present invention, the recording head includes a plurality of discharge ports and a plurality of actuators corresponding to the plurality of discharge ports, and the non-discharge driving control unit controls the driving circuit to supply the non-discharge driving signals to some of the plurality of actuators and then controls the driving circuit to supply the non-discharge driving signals to the other actuators.

According to the above-mentioned structure, it is possible to prevent crosstalk between the actuators, as compared to when a plurality of actuators is driven at the same time.

According to an eighth aspect of the present invention, in addition to the seventh aspect of the present invention, the recording head includes: a common liquid chamber that stores liquid supplied from the outside; and a plurality of individual liquid flow paths each of which includes a pressure chamber arranged so as to face the actuator, the individual liquid flow paths extending from an outlet of the common liquid chamber to the discharge port through the pressure chamber, wherein the pressure chambers are arranged in a direction along the recording head and a plurality of pressure chamber rows parallel to each other is formed in the recording head, and wherein the non-discharge driving control unit supplies the non-discharge driving signals to a plurality of actuators corresponding to a first group that includes every second pressure chamber rows, and then, the non-discharge driving control unit supplies the non-discharge driving signals to a plurality of actuators corresponding to a second group that includes every second pressure chamber rows which are different from that of the first group among the plurality of pressure chamber rows.

According to the above-mentioned structure, the liquid is stably discharged without being affected by structural crosstalk, as compared to when the non-discharge driving signals are supplied to all the actuators at the same time. In addition, the actuators are divided into two groups, and the two groups of actuators are driven at different times. That is, the actuators are divided into a minimum number of groups when the actuators are driven. Therefore, it is possible to prevent a reduction in the amount of heat generated per unit time, as compared to when the actuators are divided into three or more groups and the groups are driven at different times.

According to a ninth aspect of the present invention, in addition to the first aspect of the present invention, the driving circuit selectively supplies a plurality of kinds of discharge driving signals including different numbers of pulse signals to the actuator, the amount of liquid discharged from the discharge port when the discharge driving signal is supplied to the actuator varies depending on the kind of discharge driving signals, and the signal number calculating unit calculates the number of non-discharge driving signals such that a ratio of the number of correction pulses to the total number of discharge pulse signals supplied to the actuator within the predetermined period varies depending on the number of discharge driving signals.

According to the above-mentioned structure, even when the total number of discharge pulse signals is constant, it is possible to appropriately correct variations in the temperature of the ink jet head due to differences in printing duty.

According to a tenth aspect of the present invention, in addition to the first aspect of the present invention, the recording head includes a plurality of driving circuits, and the signal number calculating unit calculates the number of non-discharge driving signals such that the sum of the number of correction pulses and the total number of pulse signals included in the non-discharge driving signal which is supplied to the actuator within the predetermined period is the same in the plurality of driving circuits.

According to the above-mentioned structure, since a plurality of driving circuits controls the same number of pulses, it is possible to prevent differences in temperature between the driving circuits.

What is claimed is:

1. A recording apparatus comprising:

a recording head that comprises:

a discharge port through which a liquid is discharged;

an actuator that discharges the liquid from the discharge port; and a driving circuit that selectively supplies to the actuator a discharge driving signal, which includes at least one of discharge pulse signals and is used to drive the actuator so as to discharge the liquid from the discharge port, and a non-discharge driving signal, which includes at least one of non-discharge pulse signals and is used to drive the actuator so as not to discharge the liquid from the discharge port, a transport unit that transports a recording medium to a position facing the recording head;

an image recording control unit that controls the actuator to discharge the liquid onto the recording medium transported by the transport unit on the basis of image data;

a signal number calculating unit that calculates a number of non-discharge driving signals supplied from the driving circuit to the actuator on the basis of the image data; and a non-discharge driving control unit that controls the driving circuit to supply the number of non-discharge driving signals calculated by the signal number calculating unit, wherein the signal number calculating unit calculates the number of non-discharge driving signals such that the sum of a corrected number of discharge pulse signals and a total number of non-discharge pulse signals supplied to the actuator within a predetermined period is equal to a predetermined value, the corrected number of discharge pulse signals being a number which is obtained by correcting a total number of discharge pulse signals supplied to the actuator within the predetermined period to be smaller than the total number of discharge pulse signals.

2. The recording apparatus according to claim 1, wherein the number of non-discharge driving signals is calculated such that a ratio of the corrected number of discharge pulse signals to the total number of discharge pulse signals supplied to the actuator within the predetermined period varies depending on a total amount of liquid discharged from the discharge port within the predetermined period.

3. The recording apparatus according to claim 1, wherein the image recording control unit repeatedly performs an image recording process of recording an image on the recording medium, and the non-discharge driving control unit controls the driving circuit to supply the non-discharge driving signals to the actuator during a non-discharge period, which is a period from an end of a first image recording process to a start of a second image recording process that is the next process of the first image recording process.

4. The recording apparatus according to claim 3, wherein the number of non-discharge pulse signals per unit time supplied from the driving circuit to the actuator during the non-discharge period is more than a sum of the total number of discharge pulse signals and the total number of non-discharge pulse signals per unit time supplied from the driving circuit to the actuator in the first image recording process.

5. The recording apparatus according to claim 4, wherein the non-discharge driving control unit controls the driving circuit to supply the non-discharge driving signal to the actuator during the non-discharge period at a driving frequency higher than that of the discharge driving signal supplied to the actuator in the first image recording process.

6. The recording apparatus according to claim 3, wherein the predetermined period includes the non-discharge period and a period for which the first image recording process is performed before or after the non-discharge period.

7. The recording apparatus according to claim 1, wherein the recording head includes a plurality of discharge ports and a plurality of actuators corresponding to the plurality of discharge ports, and the non-discharge driving control unit controls the driving circuit to supply the non-discharge driving signals to some of the plurality of actuators and then controls the driving circuit to supply the non-discharge driving signals to the other actuators.

8. The recording apparatus according to claim 7, wherein the recording head includes:

a common liquid chamber that stores liquid supplied from the outside; and a plurality of individual liquid flow paths each of which includes a pressure chamber arranged so as to face the actuator, the individual liquid flow paths extending from an outlet of the common liquid chamber to the discharge port through the pressure chamber, wherein the pressure chambers are arranged in a direction along the recording head and a plurality of pressure chamber rows parallel to each other is formed in the recording head, and wherein the non-discharge driving control unit supplies the non-discharge driving signals to a plurality of actuators corresponding to a first group that includes every second pressure chamber rows, and then, the non-discharge driving control unit supplies the non-discharge driving signals to a plurality of actuators corresponding to a second group that includes every second pressure chamber rows which are different from that of the first group among the plurality of pressure chamber rows.

9. The recording apparatus according to claim 1, wherein the driving circuit selectively supplies a plurality of kinds of discharge driving signals including different numbers of pulse signals to the actuator, the amount of liquid discharged from the discharge port when the discharge driving signal is supplied to the actuator varies depending on the kind of discharge driving signals, and the signal number calculating unit calculates the number of non-discharge driving signals such that a ratio of the corrected number of pulse signals to the total number of discharge pulse signals supplied to the actuator within the predetermined period varies depending on the number of discharge driving signals.

10. The recording apparatus according to claim 1, wherein the recording head includes a plurality of driving circuits, and the signal number calculating unit calculates the number of non-discharge driving signals such that the sum of the corrected number of pulses and the total number of pulse signals included in the non-discharge driving signal which is supplied to the actuator within the predetermined period is the same in the plurality of driving circuits.

* * * * *